US006148962A

United States Patent [19]

Hakala et al.

[11] Patent Number: 6,148,962

[45] Date of Patent: Nov. 21, 2000

[54] TRACTION SHEAVE ELEVATOR, HOISTING UNIT AND MACHINE SPACE

[75] Inventors: Harri Hakala; Jorma Mustalahti, both of Hyvinkää; Esko Aulanko, Kerava, all of Finland

[73] Assignee: Kone OY, Helsinki, Finland

[21] Appl. No.: 08/896,531

[22] Filed: Jul. 18, 1997

Related U.S. Application Data

[63] Continuation of application No. 08/433,077, May 3, 1995, abandoned, which is a continuation-in-part of application No. 08/264,343, Jun. 23, 1994, Pat. No. 5,429,211.

[30] Foreign Application Priority Data

| | | | |
|---|---|---|---|
| Jun. 28, 1993 | [FI] | Finland | 932977 |
| Apr. 14, 1994 | [FI] | Finland | 941719 |
| May 4, 1994 | [FI] | Finland | 942062 |

[51] Int. Cl.[7] ..... B66B 11/08

[52] U.S. Cl. ..... 187/254

[58] Field of Search ..... 187/254, 266, 187/333, 325, 406

[56] References Cited

U.S. PATENT DOCUMENTS

| | | | |
|---|---|---|---|
| H702 | 11/1989 | Shively et al. | 187/406 |
| 12,640 | 4/1855 | Murtaugh | 187/251 |

(List continued on next page.)

FOREIGN PATENT DOCUMENTS

| | | | |
|---|---|---|---|
| A12127873 | 7/1993 | Canada . | |
| 415218 | 3/1991 | European Pat. Off. | 187/266 |
| 0631967 | 1/1995 | European Pat. Off. . | |
| 154553 | of 1902 | Germany | 187/254 |
| U 7395 | 9/1954 | Germany . | |
| 1033383 | 7/1958 | Germany . | |
| 3802386A1 | 8/1988 | Germany . | |
| 3922798C1 | of 1990 | Germany . | |
| 51-139044 | of 1975 | Japan . | |
| 51-20351 | of 1976 | Japan . | |

(List continued on next page.)

OTHER PUBLICATIONS

Title—Elevator Machinery ; inventors: Ing. Fuller and Ing. Knorzer dated Sep. 16, 1954, 15 pages.

"PC Brushless Motor and Control Circuit" Table of Contents and pp. 42, 43 and 204; Nov. 1, 1994.

*Primary Examiner*—William E. Terrell

*Assistant Examiner*—Khoi H. Tran

*Attorney, Agent, or Firm*—Birch, Stewart, Kolasch & Birch, LLP

[57] ABSTRACT

Traction sheave elevator consisting of an elevator car moving along elevator guide rails, a counterweight moving along counterweight guide rails, a set of hoisting ropes (3) on which the elevator car and counterweight are suspended, and a drive machine unit (6) driving a traction sheave (7) acting on the hoisting ropes (3) and placed in the elevator shaft. The drive machine unit (6) is of a flat construction. A wall of the elevator shaft is provided with a machine space with its open side facing towards the shaft, the essential parts of the drive machine unit (6) being placed in the space. The hoisting unit (9) of the traction sheave elevator consists of a substantially discoidal drive machine unit (6) and an instrument panel (8) mounted on the frame (20) of the hoisting unit.

31 Claims, 3 Drawing Sheets

U.S. PATENT DOCUMENTS

| | | | |
|---|---|---|---|
| 568,567 | 9/1896 | Herdman | 187/254 |
| 789,765 | 5/1905 | Smith | 187/266 |
| 799,337 | 9/1905 | De Buren | 187/266 |
| 1,126,260 | 1/1915 | Neenan . | |
| 1,566,385 | 12/1925 | Dunn | 187/254 |
| 3,101,130 | 8/1963 | Bianca . | |
| 4,739,969 | 4/1988 | Eckersley et al. . | |
| 4,742,891 | 5/1988 | Kunii et al. . | |
| 4,960,186 | 10/1990 | Honda | 187/254 |
| 4,977,980 | 12/1990 | Hifumi | 187/253 |
| 5,018,603 | 5/1991 | Ito . | |
| 5,036,954 | 8/1991 | Haahtikivi et al. | 187/406 |
| 5,140,212 | 8/1992 | Iwasaki et al. . | |
| 5,144,183 | 9/1992 | Farrenkopf | 310/268 |
| 5,299,662 | 4/1994 | Reddy et al. | 187/254 |
| 5,589,722 | 12/1996 | Sakaguchi et al. . | |

FOREIGN PATENT DOCUMENTS

| | | |
|---|---|---|
| 52-32870 | of 1977 | Japan . |
| 55-7149 | of 1980 | Japan . |
| 58-184480 | of 1983 | Japan . |
| 59-40276 | of 1984 | Japan . |
| 61-150982 | of 1986 | Japan . |
| 62-230587 | 10/1987 | Japan . |
| 63-56170 | of 1988 | Japan . |
| 1-187187 | of 1989 | Japan . |
| 1-267286 | of 1989 | Japan . |
| 1-30467 | of 1989 | Japan . |
| 64-21180 | of 1989 | Japan . |
| 2-225280 | of 1990 | Japan . |
| 2-62394 | of 1990 | Japan . |
| 3-124688 | of 1991 | Japan . |
| 4-50297 | of 1992 | Japan . |
| 5-78066 | of 1993 | Japan . |
| 7-137962 | of 1995 | Japan . |
| 7-144857 | of 1995 | Japan . |
| 436629 | 11/1967 | Switzerland . |
| 2201657 | 9/1988 | United Kingdom . |
| WO93/14551 | 7/1993 | WIPO . |
| WO 9528028 | 10/1995 | WIPO . |

TRACTION SHEAVE ELEVATOR, HOISTING UNIT AND MACHINE SPACE

This application is a continuation of application Ser. No. 08/433,077 filed on May 3, 1995, now abandoned, which was a CIP application of Ser. No. 08/264,343 filed on Jun. 23, 1994, now U.S. Pat. No. 5,429,211.

This invention was made with Government support under Contract DE-AC04-94AL85000 awarded by the Department of Energy. The Government has certain rights in the invention.

The present invention relates to a traction sheave elevator, a hoisting unit and a machine space as described hereinbelow.

BACKGROUND OF THE INVENTION

One of the objectives in elevator development has been to achieve an efficient and economic space utilization. In conventional traction sheave driven elevators, the elevator machine room or other space for the drive machinery takes up a considerable part of the building space required for the elevator. The problem is not only the volume of the space required by the elevator, but also its placement in the building. There are various solutions for the placement of the machine room, but they generally involve signifcant restrictions as to the design of the building at least with regard to space utilization or appearance. For example, in the case of a so-called side-drive elevator with machine room below, a machine room or space is required below or beside the shaft, generally on the bottommost floor of the elevator system. Being a special space, the machine room generally increases the building costs.

SUMMARY OF THE INVENTION

To meet the need to achieve at an economic cost a reliable elevator allowing efficient space utilization and in which, irrespective of the hoisting height, the building space required for the elevator is substantially limited to the space needed by the elevator car and counterweight on their paths, including the safety distances, and the space needed to provide a passage for the hoisting ropes, and in which the problems or drawbacks described above can be avoided, a new type of traction sheave elevator is proposed as an invention. The traction sheave elevator of the invention is characterized by an elevator car moving along elevator guide rails, a counterweight moving along counterweight guide rails, a set of hoisting ropes on which the elevator car and counterweight are suspended in the elevator shaft, and a drive machine unite driving a traction sheave placed in the elevator shaft and acting on the hoisting ropes, the drive machine unit being flat in the direction of drive shaft of the traction sheave, and a wall of the elevator shaft containing a machine space in which the essential parts of the drive machine unit are placed. The hoisting unit of the invention is characterized by the hoisting unit comprising a discoidal drive machine unit and an instrument panel attached to a frame of the hoisting unit. The machine space of the invention is characterized by the machine space being delimited in the thicknesswise direction of a wall by the plane of the wall surface facing towards an elevator shaft and the plane of the wall surface facing outwards from the elevator shaft. Other embodiments of the invention are characterized by the features presented in the other claims.

Various advantages can be achieved by applying the invention, including the following:

The traction sheave elevator of the invention allows an obvious space saving to be achieved in the building because no separate machine room is required.

The elevator is cheap to install as the elevator machinery can be assembled and tested beforehand in factory.

Applying the invention to practice requires no major changes in the design or manufacture of the elevator.

The machinery and the instrument panel are within easy reach, so the manner of accessing the machinery for maintenance or in an emergency does not essentially differ from conventional elevators.

BRIEF DESCRIPTION OF THE DRAWINGS

In the following, the invention is described in detail by the aid of one of its embodiments by referring to the attached drawings, in which.

DETAILED DESCRIPTION OF THE INVENTION

Figure 1:
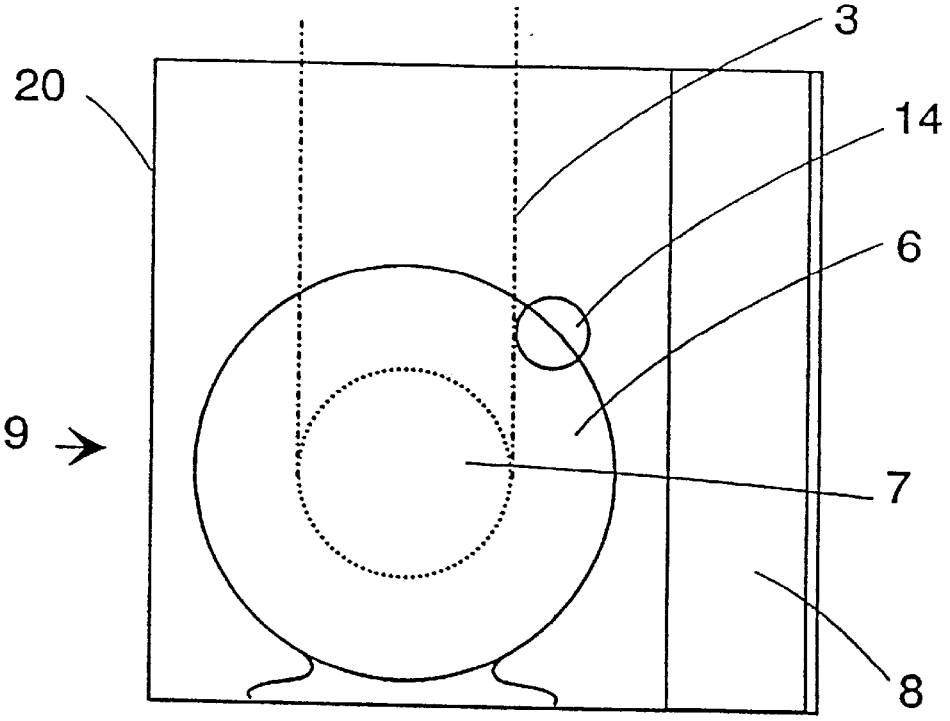
FIG. 1 presents a diagrammatic view of a hoisting unit employed in the invention.

FIG. 1 presents a hoisting unit 9 for a traction sheave elevator as provided by the invention. The unit in this figure is the hoisting unit of a traction sheave elevator with machinery below, in which the hoisting ropes 3 go upwards from the traction sheave 7 of the hoisting machinery 6. In the case of an elevator with machinery above, the ropes would go downwards. The hoisting machinery 6 is fixed to the support 20 of the hoisting unit, which 20 is preferably of a frame-like design. Mounted on the frame 20 is also an instrument panel 8, which contains the elevator control equipment and the equipment needed for the control of and supply of power to the electromotor comprised in the hoisting machinery 6. The hoisting machinery 6 is of a discoidal shape and, in relation to its diameter, relatively flat in the direction of the traction sheave shaft. The traction sheave 7 protrudes from the discoidal hoisting machinery 6 into the shaft space. Placed on the circumference of the hoisting machinery 6 is a brake 14. An elevator machinery usable as a hoisting machinery 6 is described for example only in Finnish patent application 941599. Such a machinery does not require a large machine space, so it can easily be placed in an opening in the wall or in a recess made in the wall on the side facing towards the shaft. A preferable thickness of the hoisting unit 9 is about or somewhat over ten centimetres. The traction sheave 7 is not included in this thickness. A 10 cm thick hoisting unit 9 can readily be accommodated in an ordinary elevator shaft wall because a typical wall thickness is at least about 15 cm, both in the case of a cast concrete wall and a brick wall.

Figure 2:
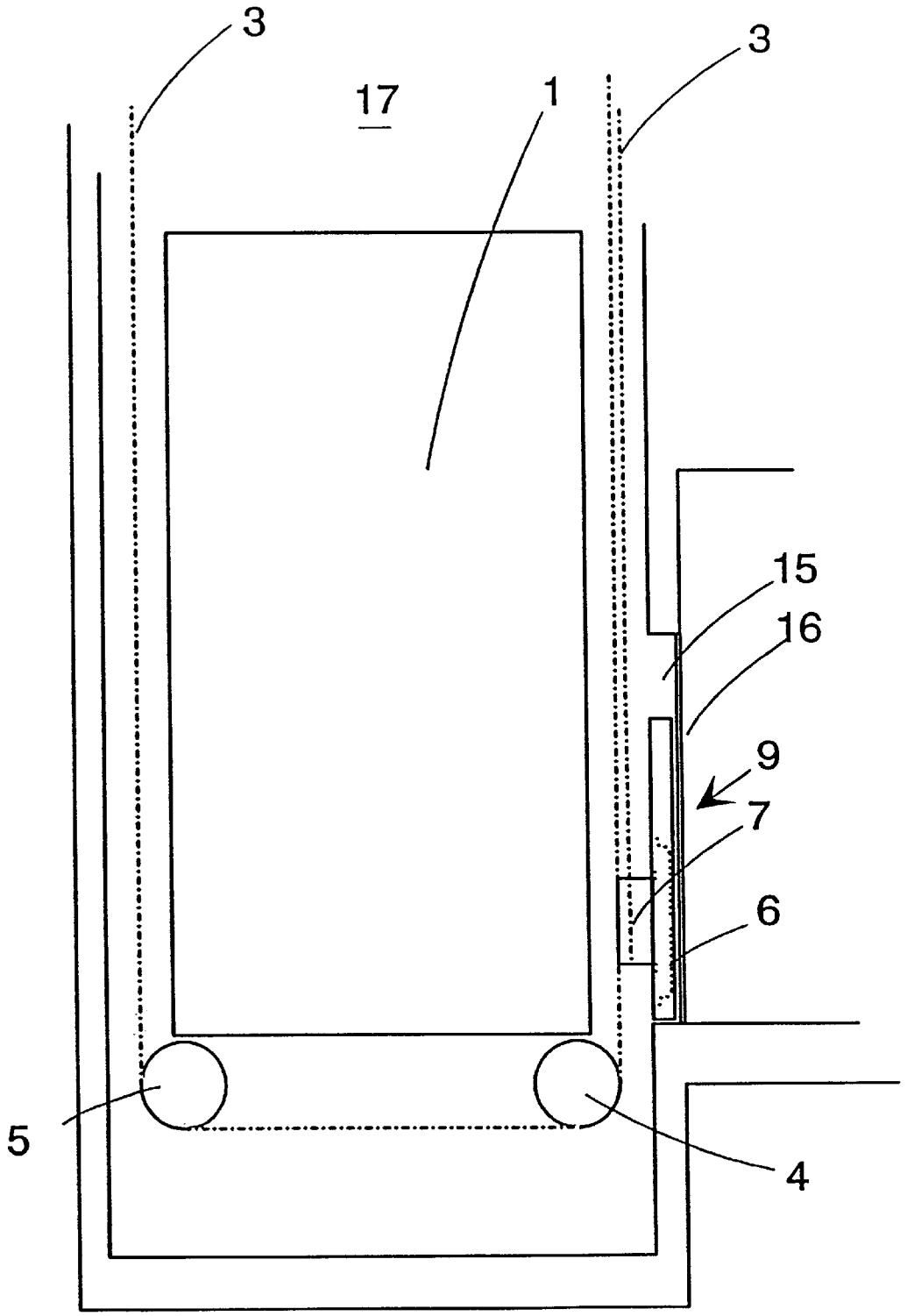
FIG. 2 presents an elevator with machinery below in which the invention is applied.

FIG. 2 presents an elevator with machinery below in which the invention is applied, the hoisting unit 9 being placed beside the shaft in its lower part. The main parts of the elevator machinery 6 are mounted in a space limited in its maximum by the thickness of the wall of the elevator shaft 17, in an opening 15 in the wall which is open towards the shaft space and closed with a door 16 from the outside to prevent illicit access to the machinery or entry into the shaft through the opening 15. On the shaft side, the opening may be provided with a safety net or glass or the like to make sure that one cannot e.g. stretch a hand into the shaft space past the equipment in the opening. In general, it is not sensible to close the machine space 15 completely from the shaft side because, regarding ventilation of the machine space 15, an advantageous solution is one in which the machine space is ventilated through the shaft. In some cases, however, closing the machine space on the shaft side may be necessary e.g. to stop the propagation of noise. In such cases the machine space 15 is closed on the shaft side except for the inlets required for power transmission to the traction sheave 7 and other purposes. In any case, the machine space 15 has a depth not exceeding the thickness of the wall of the elevator shaft 17. From the hoisting machinery 6 comprised in the hoisting unit, the traction sheave 7 moving the hoisting ropes 3 (depicted in broken lines) protrudes into the shaft 17. The figure shows the portion of the hoisting ropes pas below the car 1 over diverting pulleys 4, 5 and the portion coming down from the upper part of the shaft 17 to the traction sheave.

Figure 3:
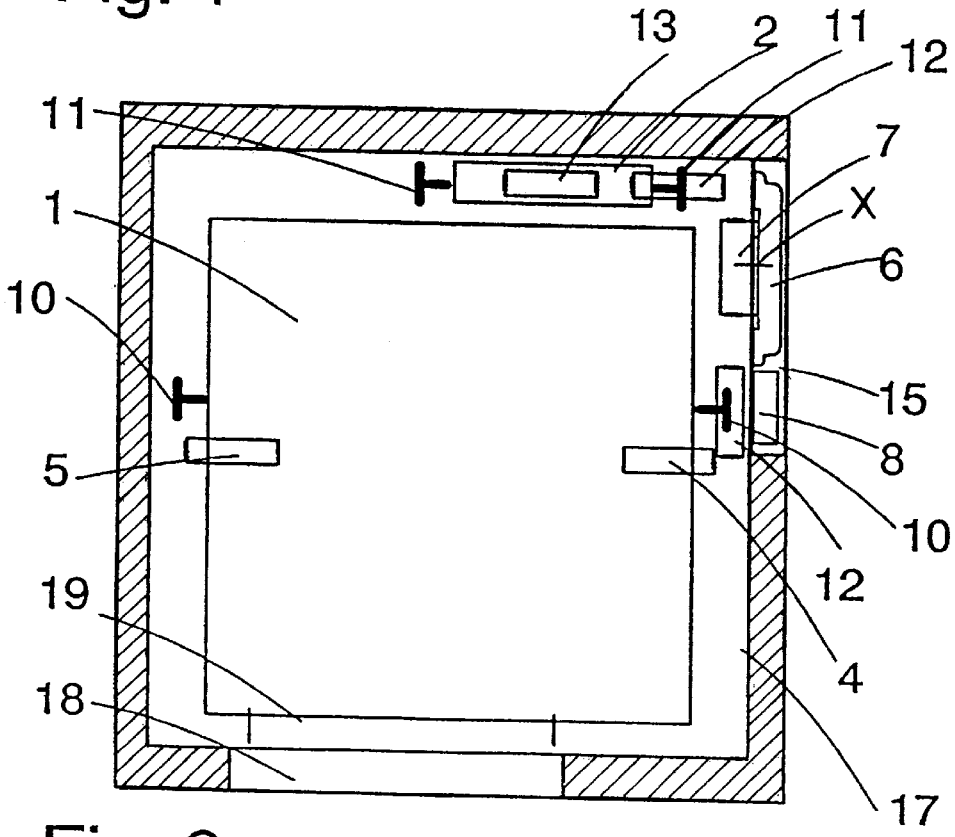
FIG. 3 presents the layout of the main components of an elevator applying the invention, projected on the cross-section of the elevator shaft.

FIG. 3 presents the layout of the main components of an elevator with machinery below, projected on the cross-section of the elevator shaft 17. The elevator car 1 moves along elevator guide rails 10 and the counterweight 2 along counterweight guide rails 11. The hoisting machinery 6 and the instrument panel 8 are placed in an opening in the wall of the elevator shaft 17. The traction sheave 7 protrudes from the hoisting machinery 6 and also from the opening 15 into the shaft 17. The axis of rotation for shaft 17 is indicated as X. Diverting pulleys 12 placed in the top part of the shaft guide the passage of the hoisting ropes. One of the diverting pulleys 12 guides the hoisting ropes from the traction sheave 7 to the diverting pulley 13 on which the counterweight 2 is suspended and from which the hoisting ropes go further to a fixed rope anchorage at the top of the shaft. Another diverting pulley 12 guides the hoisting ropes from the traction sheave 7 to the diverting pulleys 4 and 5 attached to the car 1, by means of which the elevator car 1 is suspended on the hoisting ropes and from which the ropes go further to a fixed rope anchorage at the top of the shaft. In the figure, the hoisting ropes are represented by their cross-sections on the traction sheave and diverting pulleys, but otherwise the ropes are not shown. At each landing, the wall of the elevator shaft 17 is provided with a door opening 18 for the landing door. The elevator car 1 is provided with a corresponding door opening 19. If the elevator car is provided with a door, its door opening 19 is closed by the car door.

Figure 4:
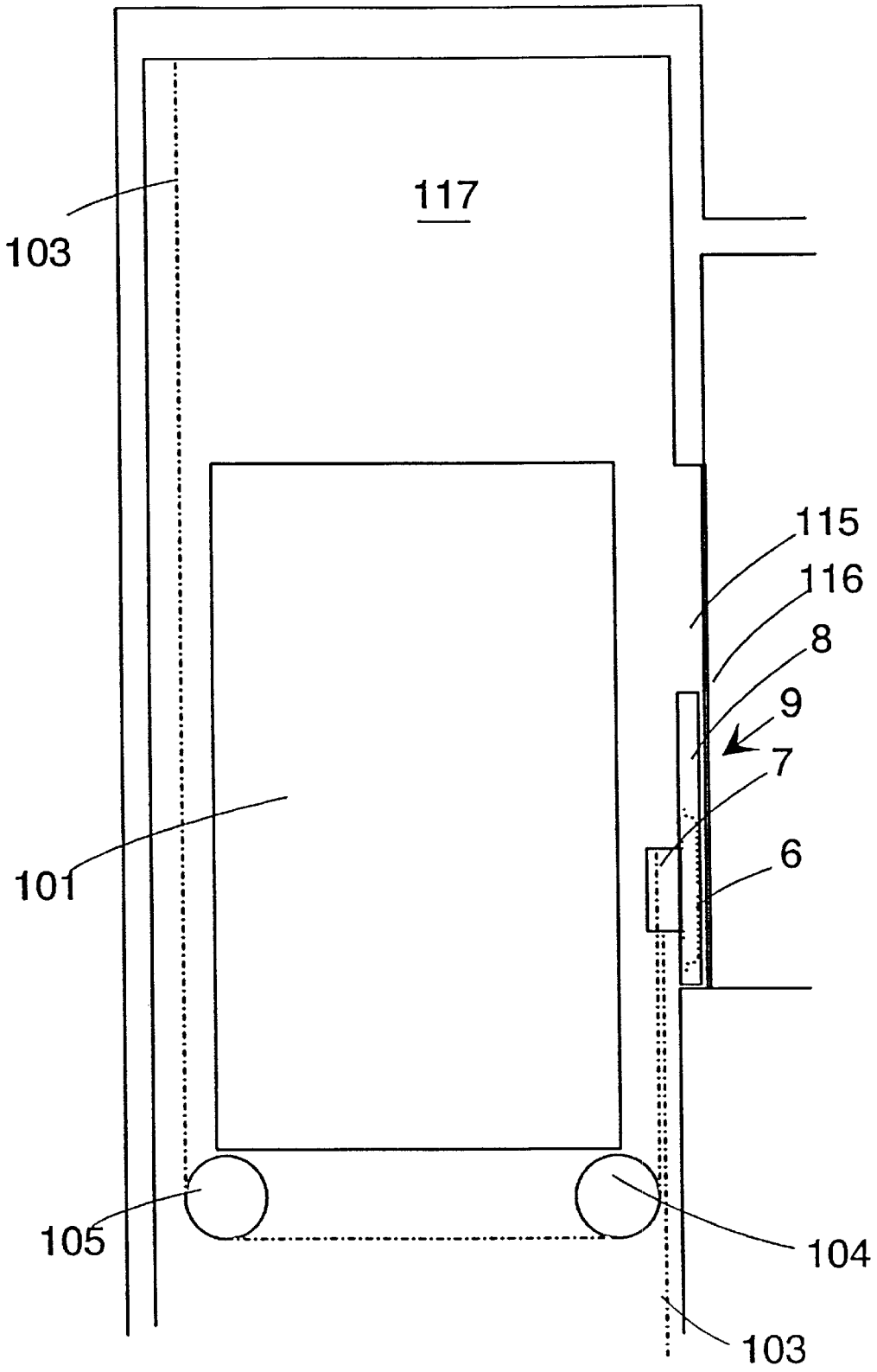
FIG. 4 presents an elevator with machinery above, implemented according to the invention.

FIG. 4 presents a diagram representing an elevator with machinery above, implemented according to the invention. The hoisting unit 9 is placed beside the elevator shaft 117 in its upper part. The elevator machinery 6 is mounted in an opening 115 in the wall of the elevator shaft 117. The opening is open towards the shaft and closed with a door 116 from the outside of the shaft. From the hoisting machinery 6 comprised in the hoisting unit, the traction sheave 7 moving the hoisting ropes 103 (depicted in broken lines) protrudes into the shaft 117. The figure shows the portion of the hoisting ropes passing below the car 101 over diverting pulleys 104, 105 and the portion going from the traction sheave towards the counterweight.

It is obvious to a person skilled in the art that different embodiments of the invention are not restricted to the examples described above, but that they may instead be varied within the scope of the claims presented below. For instance, the lay-out of the car and counterweight in the shaft is not a decisive question. It is also obvious to the skilled person that the drive shaft of the traction sheave can be provided with a support on the side facing the shaft as well, e.g. by using a support beam attached to the frame of the hoisting machinery. The skilled person also knows that the traction sheave comprised in an elevator machinery is frequently not a fixed part of the machinery but a component which need not be mounted on its drive shaft until during installation of the elevator.

We claim:

1. A traction sheave elevator system comprising:

an elevator shaft structure having at least one wall;

a plurality of guide rails;

an elevator car movable along the plurality of elevator guide rails;

a counterweight movable along a plurality of counterweight guide rails;

a set of hoisting ropes on which the elevator car and counterweight are suspended in the elevator shaft structure;

a motor having an axis of rotation oriented in the elevator shaft such that the axis will intersect an adjacent elevator car;

a traction sheave driven by the motor on the axis of rotation;

the motor being flat in the direction of the drive shaft, the elevator shaft including a shaft wall adjacent the elevator car;

the shaft wall having a pair of opposed inner and out surfaces defining a solid finite thickness;

a machine space being defined in the shaft wall, the machine space being a hole extending between the pair of opposed surfaces and being delimited in a thickness direction of the shaft wall by the plane of each of the pair of opposed surfaces of the shaft wall, the motor being mounted and contained within the machine space such that the motor does not extend beyond the outer surfaces of the shaft wall.

2. The system as defined in claim 1, wherein said machine space is open at one side towards an interior of the elevator shaft structure and has a door at the opposite side.

3. The system as defined in claim 1 or 2, wherein the motor is a discoidal electric motor and the system further comprises an instrument panel, the instrument panel containing equipment required for the control of and supply of power to the elevator car.

4. The system as defined in claim 3, wherein said machine space for the motor is disposed in a lower part of the shaft wall.

5. The system as defined in claim 3, wherein said machine space for the motor is disposed in an upper part of the shaft wall.

6. The system as defined in claim 3, wherein said machine space is provided with an access restricting element.

7. The system as defined in claim 1, wherein a majority of the motor is contained within the machine space opening.

8. The system as defined in claim 1, wherein substantially all of the motor is contained within the machine space opening.

9. The system as defined in claim 1, wherein the motor is contained within the machine space opening.

10. A traction sheave drive system which minimizes the space occupied in an elevator shaft, said drive system comprising:

an elevator shaft structure having at least one wall;

a plurality of guide rails in the elevator shaft;

an elevator car movable along the plurality of elevator guide rails;

a discoidal electric motor having a stator, a rotor, and an axis of rotation, the axis of rotation being oriented in said elevator shaft such that the axis will intersect an adjacent elevator car;

a traction sheave mounted on and directly driven by said rotor on said axis of rotation;

said elevator shaft including a shaft wall adjacent said elevator car;

said shaft wall having a pair of opposed inner and outer surfaces defining a solid finite thickness; a machine space in said wall, the machine space being a hole extending between the pair of opposed surfaces and being delimited in a thicknesswise direction of the wall by the plane of each of the pair of opposed surfaces;

said discoidal motor being mounted and contained within the machine space such that the motor does not extend beyond the outer surfaces of the machine space.

11. The invention of claim 1, wherein said discoidal electric motor is completely contained within said shaft wall.

12. A traction sheave elevator system comprising:

an elevator shaft structure having at least one wall;

a plurality of guide rails;

an elevator car movable along the plurality of elevator guide rails adjacent the at least one wall of the elevator shaft;

a motor having an axis of rotation oriented in the elevator shaft such that the axis will intersect an adjacent elevator car;

a traction sheave driven by the motor on the axis of rotation;

the elevator shaft including a shaft wall having a pair of opposed inner and outer surfaces defining a solid finite thickness; and a machine space being defined in the shaft wall, the machine space being a hole extending between the pair of opposed surfaces and being delimited in the thicknesswise direction of the wall by the plane of each of the pair of opposed surfaces;

the motor being mounted and contained within the machine space such that the motor does not extend beyond the outer surfaces of the shaft wall.

13. The system as defined in claim 12, wherein the motor is a discoidal electric motor.

14. The system as defined in claim 12, wherein the machine space is closed on one side thereof.

15. The system as defined in claim 12, wherein a space is provided between the shaft wall and the adjacent elevator car, the traction sheave being in one of the space and an extension of the space defined between the shaft wall and the adjacent elevator car.

16. The system as defined in claim 12, further comprising a traction rope operatively connected to the traction sheave and passing beneath the elevator car.

17. The system as defined in claim 16, wherein the elevator shaft is rectangular in cross-section.

18. The system as defined in claim 12, further comprising a counterweight mounted in the elevator shaft and a traction rope, the traction rope being interconnected between the counterweight, the traction sheave and the elevator car.

19. The system as defined in claim 18, wherein the traction rope passes beneath the elevator car and has a distal end remote from the counterweight, the distal end of the rope being attached to a fixed support structure in the shaft.

20. The system as defined in claim 18, wherein the counterweight is mounted in the shaft in a space defined between the shaft wall and the elevator car.

21. The system as defined in claim 18, wherein the rope passes beneath the elevator car.

22. The system as defined in claim 12, further comprising an instrument panel containing equipment required for the control of and supply of power to the elevator car.

23. The system as defined in claim 12, wherein said machine space for the motor is disposed in a lower part of the shaft wall.

24. The system as defined in claim 12, wherein said machine space for the motor is disposed in an upper part of the shaft wall.

25. The system as defined in claim 12, wherein said machine space is provided with an access restricting element.

26. A method for configuring the space occupied by an elevator car and the drive assembly associated therewith, the drive assembly including at least a motor and a traction sheave, the traction sheave being driven by the motor the method comprising the steps of:

providing an elevator shaft structure having at least one wall;

placing the elevator car in the elevator shaft, the elevator car being movable along a plurality of guide rails provided in the shaft;

arranging an axis of rotation of the motor to be oriented in the elevator shaft such that the axis will intersect an adjacent elevator car;

providing a shaft wall in the elevator shaft, the shaft wall having a pair of opposed inner and outer surfaces defining a solid finite thickness; defining a machine space in the shaft wall, the machine space being a hole extending between the pair of opposed surfaces and being delimited in the thicknesswise direction of the wall by the plane of each of the pair of opposed surfaces; and mounting the motor to be contained within the machine space such that the motor does not extend beyond the outer surfaces of the shaft wall.

27. The method as defined in claim 26, further comprising the step of providing a discoidal electric motor as the motor.

28. The method as defined in claim 26, further comprising the steps of:

providing a counterweight in the shaft;

providing a first guide assembly in the shaft to hold and define a path of travel for the counterweight;

providing a second guide assembly in the shaft for the elevator car;

spacing the shaft wall from the elevator car to an extend required to accommodate the thickness dimension of the counterweight, one of the guide assemblies and requisite safety distances; and connecting the counterweight and the elevator car with a rope.

29. The method as defined in claim 28, further including the step of mounting the motor adjacent at least one of the guide assemblies to present the traction sheave for rotation within a space extending between the shaft wall and the elevator car.

30. The method as defined in claim 26, wherein a space is provided between the shaft wall and the elevator car and wherein the method further comprises the step of mounting the motor to present the traction sheave for rotation within one of the space and an extension of the space.

31. The method as defined in claim 26, further comprising the step of suspending the elevator car on a hoisting rope passing beneath the elevator car.

* * * * *